US011854104B1

(12) United States Patent
Shao et al.

(10) Patent No.: US 11,854,104 B1
(45) Date of Patent: Dec. 26, 2023

(54) METHODS AND SYSTEMS FOR MANAGING SCHOOL ATTENDANCE OF SMART CITY BASED ON THE INTERNET OF THINGS

(71) Applicant: CHENGDU QINCHUAN IOT TECHNOLOGY CO., LTD., Sichuan (CN)

(72) Inventors: Zehua Shao, Chengdu (CN); Bin Liu, Chengdu (CN); Yaqiang Quan, Chengdu (CN); Yong Li, Chengdu (CN); Xiaojun Wei, Chengdu (CN)

(73) Assignee: CHENGDU QINCHUAN IOT TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 17/812,178

(22) Filed: Jul. 13, 2022

(30) Foreign Application Priority Data

May 18, 2022 (CN) ..... 202210536307.8

(51) Int. Cl.
*G06Q 50/20* (2012.01)

(52) U.S. Cl.
CPC ..... *G06Q 50/205* (2013.01)

(58) Field of Classification Search
CPC ..... G06Q 50/205
USPC ..... 705/326
See application file for complete search history.

(56) References Cited

U.S. PATENT DOCUMENTS

2018/0315145 A1* 11/2018 Darnell ..... H04L 9/3239
2021/0006933 A1* 1/2021 Dean ..... G16Y 40/10

FOREIGN PATENT DOCUMENTS

CN 106952197 A 7/2017
CN 108230471 A * 6/2018 ..... G06Q 50/205
CN 108764701 A 11/2018
CN 108920701 A 11/2018
CN 109409757 A 3/2019
CN 109829567 A 5/2019
CN 111461738 A 7/2020
CN 111898902 A 11/2020
CN 112579863 A 3/2021
CN 112651864 A * 4/2021
(Continued)

OTHER PUBLICATIONS

Liu, Haiping, "Smart campus student management system based on 5G network and Internet of Things", Nov. 2020, DOI: 10.1016/j.micpro.2020.103428, https://www.researchgate.net/publication/346874710_Smart_campus_student_management_system_based_on_5G_network_and_Internet_of_Things (Year: 2020).*
(Continued)

*Primary Examiner* — Laura Yesildag
*Assistant Examiner* — Rebecca R Novak
(74) *Attorney, Agent, or Firm* — METIS IP LLC

(57) ABSTRACT

The embodiments of the present disclosure provide a method for managing school attendance of a smart city based on the Internet of Things, which is implemented by a school attendance management platform. The method for managing school attendance includes: obtaining student registration information based on a student user platform; obtaining student evaluation scores based on a plurality of school user sub-platforms; aggregating the student registration information and the student evaluation scores through a school attendance service platform to obtain aggregated data; and determining school place allocation based on the aggregated data.

5 Claims, 6 Drawing Sheets

(56) References Cited

FOREIGN PATENT DOCUMENTS

| | | | | |
|---|---|---|---|---|
| CN | 112651864 | A | | 4/2021 |
| CN | 114004524 | A | | 2/2022 |
| CN | 114037576 | A | | 2/2022 |
| CN | 114169603 | A | | 3/2022 |
| KR | 20150133055 | A | * | 11/2015 |

OTHER PUBLICATIONS

First Office Action in Chinese Application No. 202210536307.8 dated Jul. 7, 2022, 17 pages.
The Second Office Action in Chinese Application No. 202210536307.8 dated Jul. 27, 2022, 22 pages.
Notification to Grant Patent Right for Invention in Chinese Application No. 202210536307.8 dated Aug. 19, 2022, 6 pages.
Shao, Zehua, Exploration and Research on the Structure of Internet of Things, Internet of Things Technologies Reliable Transmission, 2015, 10 pages.
Shao, Zehua, The Internet of Things sense the world beyond the world, China Renmin University Press. 2017, 30 pages.
Shao, Zehua, Smart City Architecture, Internet of Things Technologies Intelligent Processing and Application, 2016, 7 pages.
White Paper on Urban Brain Development, Smart City Standard Working Group of National Beacon Commission, 2022, 59 pages.
Yan, Hui, Methodology of Secondary School Places Allocation in Hong Kong, Primary and Secondary School Management, 1998, 3 pages.
Xiong, Limin, A Review and Implications of Nine-Year Compulsory Education in Hong Kong, Comparative Education Research, 1998, 14 pages.
Lin, Xun et al., Design and Implementation of Primary and Secondary Schools Admission Dicing System Based on Proximity Principle, Computer Era, 8: 27-29, 2009.
Chai, Hongfeng et al., Introduction to Blockchain, China Science and Technology Press, 2020, 24 pages.
Gong, Jian et al., Industrial Blockchain: 100 Case Studies on the Global Implementation of New Infrastructure Blockchain, China Radio, Film and Television Press, 2021, 7 pages.
Kong, Yunfeng et al., Spatial Modeling and Analysis of the Nearby School Enrollment: A Case Study of the Junior Middle Schools in Gongyi City, Henan Province, Geography and Geo-Information Science, 27(5): 87-90,98, 2011.
Muladi et al., Predicting High School Graduates Using Naive Bayes in State University Entrance Selections, 2020 The 4th International Conference on Vocational Education and Training, 155-159, 2020.

* cited by examiner

METHODS AND SYSTEMS FOR MANAGING SCHOOL ATTENDANCE OF SMART CITY BASED ON THE INTERNET OF THINGS

CROSS-REFERENCE TO RELATED APPLICATION

This application claims priority of Chinese Patent Application No. 202210536307.8, filed on May 18, 2022, the contents of which are entirely incorporated herein by reference.

TECHNICAL FIELD

The present disclosure generally relates to the field of Internet of Things systems and cloud platforms, and in particular, to methods and systems for managing school attendance of smart city based on the Internet of Things.

BACKGROUND

Education equity has always been widely concerned in the society, especially the enrollment of students in the compulsory education stage has always been the focus of attention of parents and students. In the past period, many schools have adopted methods such as examinations and exemptions for students with special abilities to recruit students. These methods lead to a trend of choosing schools, making it difficult to ensure a reasonable distribution of educational resources, and creating a bad phenomenon of pursuing test scores and ignoring quality education. Under the premise of ensuring fair and reasonable school place allocation, how to solve the problem that students choose schools in the compulsory education stage is an urgent problem to be solved.

Therefore, it is hoped to provide a method and system for managing school attendance of smart city based on the Internet of Things, which uses the Internet of Things and cloud platform to improve the efficiency of school attendance, while ensuring fair and reasonable school place allocation.

SUMMARY

The one or more embodiments of the present disclosure provide a method for managing school attendance of a smart city based on the Internet of Things, which is implemented by a school attendance management platform. The method for managing school attendance includes: obtaining student registration information based on a student user platform; obtaining student evaluation scores based on a plurality of school user sub-platforms; aggregating the student registration information and the student evaluation scores through a school attendance service platform to obtain aggregated data; and determining school place allocation based on the aggregated data.

The one or more embodiments of the present disclosure provide a system for managing school attendance of a smart city based on the Internet of Things, including: a school attendance management platform, a school attendance service platform, and a user platform, wherein the user platform includes a student user platform and a school platform; and the school platform includes a plurality of school user sub-platforms; wherein the school attendance management platform is configured to: obtain student registration information based on a student user platform; obtain student evaluation scores based on a plurality of school user sub-platforms; aggregate the student registration information and the student evaluation scores through a school attendance service platform to obtain aggregated data; and determine school place allocation based on the aggregated data.

The one or more embodiments of the present disclosure provide a computer-readable storage medium storing computer instructions, wherein when reading the computer instructions in the storage medium, a computer implements the method for managing school attendance of a smart city based on the Internet of Things.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
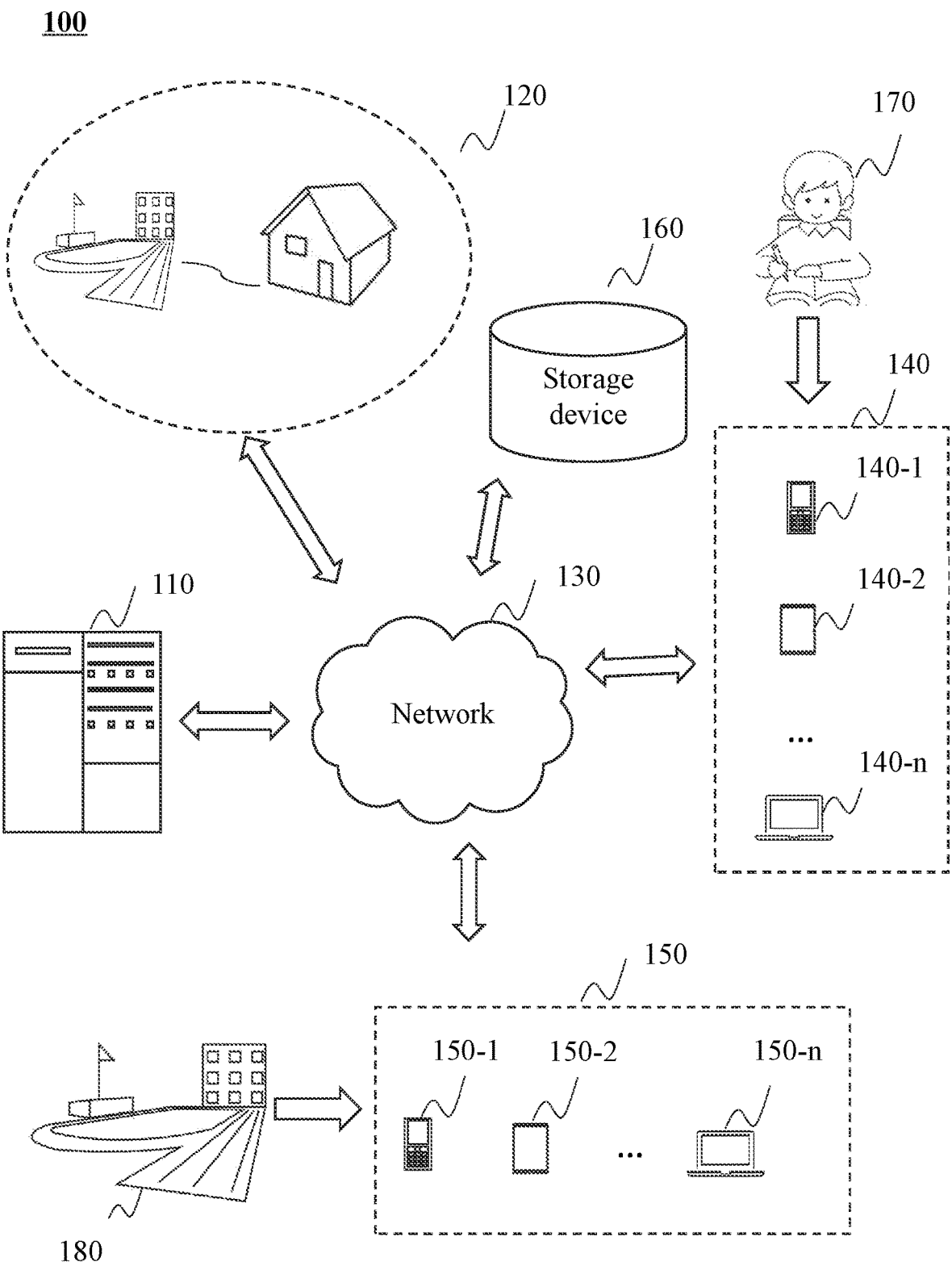
FIG. 1 is a schematic diagram illustrating an application scenario of a system for managing school attendance of a smart city based on the Internet of Things according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. It should be understood that the purposes of these illustrated embodiments are only provided to those skilled in the art to practice the application, and not intended to limit the scope of the present disclosure. Unless obviously obtained from the context or the context illustrates otherwise, the same numeral in the drawings refers to the same structure or operation.

It will be understood that the terms "system," "engine," "unit," "module," and/or "block" used herein are one method to distinguish different components, elements, parts, sections, or assemblies of different levels in ascending order. However, the terms may be displaced by other expressions if they may achieve the same purpose.

The terminology used herein is for the purposes of describing particular examples and embodiments only and is not intended to be limiting. As used herein, the singular forms "a," "an," and "the" may be intended to include the plural forms as well, unless the context clearly indicates otherwise; and the plural forms may be intended to include the singular forms as well, unless the context clearly indicates otherwise. It will be further understood that the terms "include" and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

The flowcharts used in the present disclosure illustrate operations that systems implement according to some embodiments of the present disclosure. It is to be expressly understood, the operations of the flowcharts may be implemented not in order. Conversely, the operations may be implemented in an inverted order, or simultaneously. Moreover, one or more other operations may be added to the flowcharts. One or more operations may be removed from the flowcharts.

FIG. 1 is a schematic diagram illustrating an application scenario 100 of a system for managing school attendance of a smart city based on the Internet of Things according to some embodiments of the present disclosure.

An application scenario 100 may include a server 110, a geographic information platform 120, a network 130, a first terminal device 140, a second terminal device 150 and a storage device 160. In some embodiments, a school attendance management platform, a school attendance service platform, and a user platform may be disposed on the one or more servers 110. In some embodiments, the user platform may include a student user platform and a school platform, and the school platform may include one or more school user sub-platforms.

In some embodiments, users of the first terminal device 140 and the second terminal device 150 may be students or schools. In some embodiments, the user of the first terminal device 140 may be a student, the first terminal device 140 may be a terminal device of a student user platform, and the terminal device of the student user platform 140 may include one or more terminal devices of the student user platform. For example, the terminal device of the student user platform 140 may include a terminal device of the student user platform 140-1, a terminal device of the student user platform 140-2, a terminal device of the student user platform **140-*n***, etc.

In some embodiments, the user of the second terminal device 150 may be a school, the second terminal device 150 may be a terminal device of a school platform, and the terminal device of the school platform 150 may include one or more terminal devices of the school user sub-platform. For example, the terminal device of the school platform 150 may include a terminal device of the school user sub-platform 150-1, a terminal device of the school user sub-platform 150-2, a terminal device of the school user sub-platform **150-*n***, etc.

In some embodiments, the application scenario 100 may determine school place allocation by implementing the methods and/or systems for managing school attendance disclosed in the present disclosure. For example, in a typical application scenario, student registration information is obtained through the first terminal device 140 when it is necessary to perform school place allocation. The school attendance service platform disposed on the server 110 sends an instruction based on an intention for school attendance in the student registration information to a terminal device of a school user sub-platform (also referred to as school user sub-platform terminal device) in the second terminal devices 150 corresponding to the intention of the student for school attendance to obtain the corresponding student evaluation scores. The student registration information and student evaluation scores are aggregated by the school attendance service platform disposed on the server 110 and sent to the school attendance management platform disposed on the server 110. The school attendance management platform determines the school place allocation based on aggregated data. In this way, under the premise of taking into account the intention of the student for school attendance/school selection, nearby enrollment and balance of performance, the school place allocation is automatically realized to ensure the fairness of the school place allocation.

In some embodiments, the server 110 may be used to process information and/or data related to the application scenario 100. For example, the school attendance management platform disposed on the server 110 may be used to determine school place allocation based on aggregated data. For another example, the school attendance service platform disposed on the server 110 may aggregate student registration information and the student evaluation scores. For another example, the school attendance service platform disposed on the server 110 may send an instruction to a school user sub-platform corresponding to an intention for school attendance of a student based on the intention for school attendance of the student. In some embodiments, the server 110 may be a single server or a group of servers. The group of servers may be centralized or distributed (e.g., the school management platform server 110 may be a distributed system), may be dedicated or served by other devices or systems at the same time. In some embodiments, the server 110 may be regional or remote. In some embodiments, the server 110 may be implemented on a cloud platform, or provided in a virtual fashion.

In some embodiments, the server 110 may include a processing device. The processing device may process data and/or information obtained from other devices or system components. The processing device may execute program instructions based on the data, information and/or processing results to perform one or more functions described in the present disclosure. For example, the processing device may obtain student registration information based on the first terminal device 140, and obtain the student evaluation scores based on a plurality of second terminal devices (e.g., 150-1, 150-2, **150-*n*, etc.). For another example, the processing device may aggregate the student registration information and the student evaluation scores through the school attendance service platform disposed on the server 110, and determine school place allocation based on the aggregated data. For another example, the processing device may send an instruction to the school user sub-platform terminal devices (for example, 150-1, 150-2 or 150-*n*) corresponding to the intentions of the students for school attendance through the school attendance service platform disposed on the server 110** based on the intentions of the students for school attendance, to obtain the corresponding student evaluation scores. As another example, the processing device may determine a ranking score of the student at an interest school based on a distance score, the student evaluation score, and a draw score. As another example, the processing device may determine a ranking of the student at the interest school based on the ranking score. In some embodiments, the processing device may include one or more sub-processing devices (e.g., a single-core processing device or a multi-core multi-core processing device). Merely by way of example, the processing device may include a central processing unit (CPU), an application specific integrated circuit (ASIC), an application specific instruction processor (ASIP), a graphics processing unit (GPU), a microprocessor, or the like, or any combination thereof.

In some embodiments, the geographic information platform 120 may be used to provide distance information and/or data related to determining school place allocation to the school attendance management platform disposed on the server 110. For example, a geographic information platform server may obtain the distance between the house of the student and the school, and may transmit it to the school attendance management platform disposed on the server 110 through the network 130.

In some embodiments, the network 130 may facilitate the exchange of information and/or data. In some embodiments, one or more components of the application scenario 100 (e.g., the server 110, the geographic information platform 120, the network 130, the first terminal device 140, the second terminal device 150, and the storage device 160) may transfer information and/or data via the network 130 to other components of the application scenario 100. For example, the school attendance management platform disposed on the server 110 may obtain the student registration information from the first terminal device 140 via the network 130.

In some embodiments, the network 130 may be a wired network or a wireless network, or the like, or any combination thereof. For example, the network 130 may include a cable network, a fiber optic network, a telecommunications network, an internet, a local area network (LAN), a wide area network (WAN), a wireless local area network (WLAN), a metropolitan area network (MAN), a public switched telephone network (PSTN), a Bluetooth network, etc., or any combination thereof. In some embodiments, the network 130 may include one or more network access points. For example, the network 130 may include wired or wireless network access points, such as base stations and/or network exchange points, through which one or more components of the application scenario 100 may connect to the network 130 to exchange data and/or information.

In some embodiments, the first terminal device 140 may be one or more terminal devices or software for use by students. In some embodiments, the first terminal device 140 may obtain the student registration information. In some embodiments, the first terminal device 140 may be one or any combination of other devices with input and/or output functions, such as a mobile device, a tablet computer, a laptop computer, etc.

In some embodiments, the second terminal device 150 may be one or more terminal devices or software used by the school to obtain the student evaluation scores based on the obtained student registration information. In some embodiments, the second terminal device 150 may obtain the student evaluation scores. In some embodiments, the second terminal device 150 may be one or any combination of other devices with input and/or output functions, such as a mobile device, a tablet computer, a laptop computer, etc.

In some embodiments, the storage device 160 may be used to store data and/or instructions. In some embodiments, the storage device 160 may store data obtained from terminal devices (e.g., the first terminal device 140, the second terminal device 150). In some embodiments, the storage device 160 may store data and/or instructions used by the server 110 to perform or use to accomplish the example methods described in the present disclosure. In some embodiments, the storage device 160 may include a mass storage, a removable storage, a read-write memory, a read-only memory, or the like, or any combination thereof. Illustratively, the mass storage may include a magnetic disk, an optical disk, and the like. In some embodiments, the storage device 160 may be implemented on a cloud platform.

In some embodiments, the storage device 160 may be connected to the network 130 to communicate with one or more components of the application scenario 100 (e.g., the server 110, the geographic information platform 120, the network 130, the first terminal device 140, the second terminal device 150 and the storage device 160). One or more components of the application scenario 100 may access data or instructions stored in the storage device 160 via the network 130. In some embodiments, the storage device 160 may be directly connected or in communication with one or more components of the application scenario 100. In some embodiments, one or more components of the application scenario 100 may have permissions to access the storage device 160. In some embodiments, the storage device 160 may be part of the server 110.

In some embodiments, a student 170 may refer to a person enrolling in the school place allocation. A school 180 may refer to a school that offers the school places to be allocated to students according to the methods and/or systems for managing school attendance disclosed in the present disclosure.

In some embodiments, the application scenario 100 may also include a blockchain. The blockchain may be used to store encrypted data, decrypt a key, and output a decryption key. In some embodiments, the blockchain may store several pairs of random numbers and draw scores randomly generated by the application scenario 100. In some embodiments, the blockchain may output the decryption key to the school attendance management platform disposed on the server 110.

The Internet of Things (I) system is an information processing system that includes part or all of platforms, which include a user platform, a service platform, and a management platform. The user platform is a leader of the IoT operation system, which may be used to obtain user needs. The user needs are the basis and premise of the formation of the IoT operation system, which is needed to be satisfied by the connection between the IoT platforms. The service platform is a bridge located between the user platform and the management platform to connect the user platform and the management platform. The service platform may provide the user with input and output services. The management platform may realize the overall planning and coordination of the connection and cooperation between various functional platforms (e.g., the user platform, the service platform, the sensor network platform, and the object platform). The management platform gathers the information of the IoT operation system and may provide perception management and control management functions for the IoT operation system.

The information processing in the IoT system may be divided into the processing flow of perception information and the processing flow of controlling information. The controlling information may be information generated based on the perception information. The processing of the perception information is transmitted from the management platform to the service platform, and finally reaches the user platform. The controlling information is sent by the user platform, and then reaches the management platform through the service platform in turn.

In some embodiments, when the IoT system is applied to city management, it may be referred to as a smart city IoT system.

Figure 2:
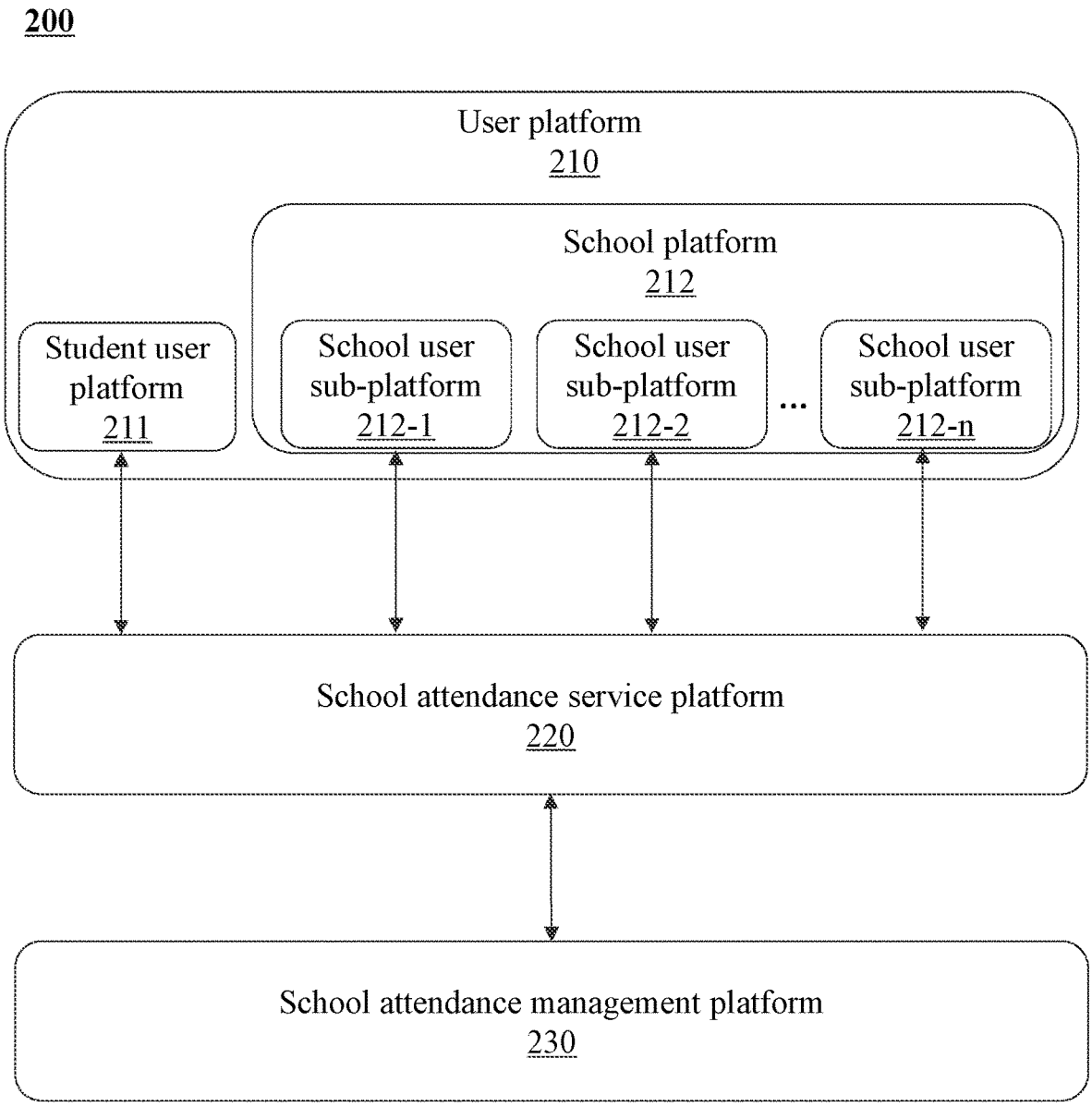
FIG. 2 is an exemplary diagram illustrating a structure of a system for managing school attendance of a smart city based on the Internet of Things according to some embodiments of the present disclosure.

FIG. 2 is a schematic diagram illustrating an exemplary structure of a system for managing school attendance of a smart city based on the Internet of Things according to some embodiments of the present disclosure.

As shown in FIG. 2, a system for managing school attendance 200 may be implemented based on the IoT system, and the system for managing school attendance 200 may include a user platform 210, a school attendance service platform 220, and a school attendance management platform 230.

In some embodiments, the system for managing school attendance 200 may be applied to various scenarios of school attendance management. In some embodiments, various scenarios of school attendance management may include scenarios such as a student distribution, a teacher distribution, a teaching material distribution, and school building construction. It should be noted that the above scenarios are only examples, and do not limit the specific application scenarios used for the system for managing school attendance 200. Those skilled in the art may apply the system for managing school attendance 200 to any other suitable scenarios based on the content disclosed in this embodiment. In some embodiments, the system for managing school attendance 200 may separately obtain student data, teacher data, school data, etc. under various scenarios, to obtain a management strategy for managing school attendance. In some embodiments, the system for managing school attendance 200 may obtain a management strategy for managing school attendance of the entire region (e.g., the entire city) based on the obtained data related to school attendance in various scenarios.

In some embodiments, the system for managing school attendance 200 may be applied to the student distribution. When it is applied to the student distribution, the user platform may be used to collect information of school-age children of each family, such as house address, gender, age, school in progress, next-level interest school, school performance, etc. The school attendance service platform may aggregate the collected information to the school attendance management platform, and the school attendance management platform analyzes and processes the received data. For example, the school attendance management platform counts the amount of students in each area according to the residence of students, and predicts the flow of students in each area based on the principle of nearby distribution, so that each school may be notified in advance based on the predicted data.

In some embodiments, the system for managing school attendance 200 may be applied to teacher management. When it is applied to the teacher management, the user platform may be used to collect the current teacher status of each school and the graduate information of each normal college, for example, the school or region where the graduate intends to work, the location of the family of the graduate, etc. The school attendance service platform may aggregate the collected information to the school attendance management platform, and the school attendance management platform analyzes and processes the received data, and combines historical information to predict the new teachers that may possibly join schools in various regions. Therefore, the school attendance service platform may identify schools and regions with saturated teachers and schools and regions with insufficient teachers, and then assist schools with obvious insufficient teachers to formulate entry benefits in advance, thereby increasing the attractiveness of school to teachers.

In some embodiments, the system for managing school attendance 200 may be applied to the teaching material distribution management. When it is applied to the teaching material distribution management, the user platform may be used to collect the current teaching material situation of each school, the information about the teaching materials to be applied for, and the relatively sufficient or redundant teaching materials. The school attendance service platform may aggregate the collected information to the school attendance management platform, and the school attendance management platform analyzes and processes the received data, and combines historical information to predict the donated teaching materials that schools in various regions may receive, or some teaching materials may need to be updated, etc. The school attendance service platform then aggregates the data to comprehensively analyze what materials are in short supply and what materials are abundant. The corresponding materials in some regions with abundant materials may be allocated to the regions where the materials are in short supply, to save procurement costs and maximize the use of teaching materials.

In some embodiments, the system for managing school attendance 200 may be applied to the school building construction management. When it is applied to the school building construction management, the user platform may be used to collect the current school building conditions, years of use, number of students, number of teachers, and courses offered in each school. The school attendance service platform may aggregate the collected information to the school attendance management platform. The school attendance management platform analyzes and processes the received data, and predicts the service life of the existing school buildings based on historical information, and combines the situation of teachers and students of each school, makes an estimate of the school buildings required by the school. For schools with sufficient school buildings, the excess school buildings may be used to carry out special courses, and may be used as public school buildings (e.g., dormitories) that may be borrowed by nearby schools in order to maximize the use of resources. For schools that may have a large demand for school attendance, the construction of new school buildings may be prepared in advance so that students may be provided with safe and healthy school buildings when they need to use the school buildings. For some areas that may welcome a large number of school-aged children, the construction of schools may be planned in advance so that children may be enrolled nearby, etc.

In some embodiments, the system for managing school attendance 200 may also implement a fusion application of multi-scenario information, to implement comprehensive management. For example, the system for managing school attendance 200 may obtain school attendance information of the student, information of the intention for school attendance, suggestions for schools, etc. based on the student user platform. For another example, the system for managing school attendance 200 may obtain job information of the teacher, intention for the job, career planning, and suggestions for schools, etc. based on a teacher user platform. For another example, the system for managing school attendance 200 may obtain information of the student and teacher at school, offered course information, current school building information, and school building information under construction, etc. based on the school user platform. For another example, the system for managing school attendance 200 may enable the school attendance service platform to aggregate the collected information to the school attendance management platform, and the school attendance management platform may analyze and process the received data, thereby obtaining regional school construction plans, teacher distribution plans, and the like.

For those skilled in the art, after understanding the principle of the system, it is possible to move the system to any other suitable scenario without departing from this principle.

The following will take the application of the system for managing school attendance 200 of the smart city based on the IoT to the scenario of the student distribution as an example to describe the system for managing school attendance 200 in detail.

In some embodiments, the user platform 210 may obtain user requirements and feed back information to other platforms (e.g., the school attendance service platform). In some embodiments, the user platform 210 may include a student user platform 211 and a school platform 212. The school platform may include one or more school user sub-platforms (e.g., a school user sub-platform 212-1, a school user sub-platform 212-2, a school user sub-platform **212-*n***, etc.). The student user platform may be used to obtain the student registration information, and transmit the obtained student registration information to other platforms (e.g., the school attendance service platform). The school platform may obtain the student evaluation scores based on the student registration information, and transmit the obtained evaluation scores to other platforms (e.g., the school attendance service platform).

The school attendance service platform 220 may be located between the user platform 210 and the school attendance management platform 230 to realize the communication between the user platform 210 and the school attendance management platform 230. In some embodiments, the school attendance service platform 220 may aggregate the student registration information obtained through the student user platform 211 and the student evaluation scores obtained through the school platform 212, and upload the aggregated data to the school attendance management platform 230.

The school attendance management platform 230 may realize the overall planning and coordination of the connection and cooperation between various functional platforms (e.g., the user platform, the school attendance service platform), and then determine the school place allocation. In some embodiments, the school attendance management platform 230 may be configured to obtain the student registration information based on the student user platform. The school attendance management platform 230 may also be configured to obtain the student evaluation scores based on a plurality of school user sub-platforms. The school attendance management platform 230 may also be configured to aggregate the student registration information and the student evaluation scores through the school attendance service platform. The school attendance management platform 230 may also be configured to determine the school place allocation based on the aggregated data.

In some embodiments, the student registration information may include the intention of each student for school attendance. In some embodiments, the school attendance management platform 230 may be configured to, based on the intention of the student for school attendance, send an instruction to a school user sub-platform corresponding to the intention of the student for school attendance through the school attendance service platform to obtain the corresponding student evaluation score corresponding to the student. The school attendance management platform 230 may be configured to determine a ranking score of the student at an interest school based on a distance score, the student evaluation score, and a draw score. The school attendance management platform 230 may be configured to determine a ranking of the student at an interest school based on the ranking score.

In some embodiments, the ranking score of the student at the interest school may be determined based on a weighted sum of the distance score, the student evaluation score, and the draw score. In some embodiments, the draw score may be determined based on a random number selected by the student; the random number and the corresponding draw score are randomly generated and stored in a blockchain. In some embodiments, the data in the blockchain is stored encrypted, and the decryption key is also stored in the blockchain for verification; the decryption key is disclosed by the school attendance management platform after drawing lots.

In some embodiments, the school attendance management platform 230 may be configured to obtain a selection result (a result for selecting ranking candidate schools by the student) made by the student for ranking candidate schools based on the student user platform. The school attendance management platform 230 may also be configured to aggregate the selection results of all students based on the school attendance service platform and send them to the school attendance management platform. The school attendance management platform 230 may also be configured to determine the school place allocation in conjunction with the selection results. The ranking candidate school includes at least one school with the highest ranking score corresponding to the student; the selection result includes at most selecting one of the ranking candidate schools.

In some embodiments, the school attendance management platform 230 may be configured to, based on the school place allocation, obtain distance information between a house of each student and a school from the geographic information platform, and combine a performance of the student to determine whether the school place allocation meets an evaluation index.

In some embodiments, the school attendance management platform 230 may be configured to adjust a parameter of the school place allocation in response to the school place allocation not meeting the evaluation index.

More details on the school attendance management platform 230, please refer to FIGS. 3-6 and the descriptions.

It should be noted that the above description of the system and its components is only for the convenience of description, and does not limit the description to the scope of the illustrated embodiments. It may be understood that for those skilled in the art, after understanding the principle of the system, it is possible to arbitrarily combine the various components, or form a sub-system to connect with other components without departing from the principle. For example, the school attendance service platform and the school attendance management platform may be integrated in one component. For another example, each component may share one storage device, and each component may also have its own storage device. Such deformations are all within the protection scope of the present disclosure.

Figure 3:
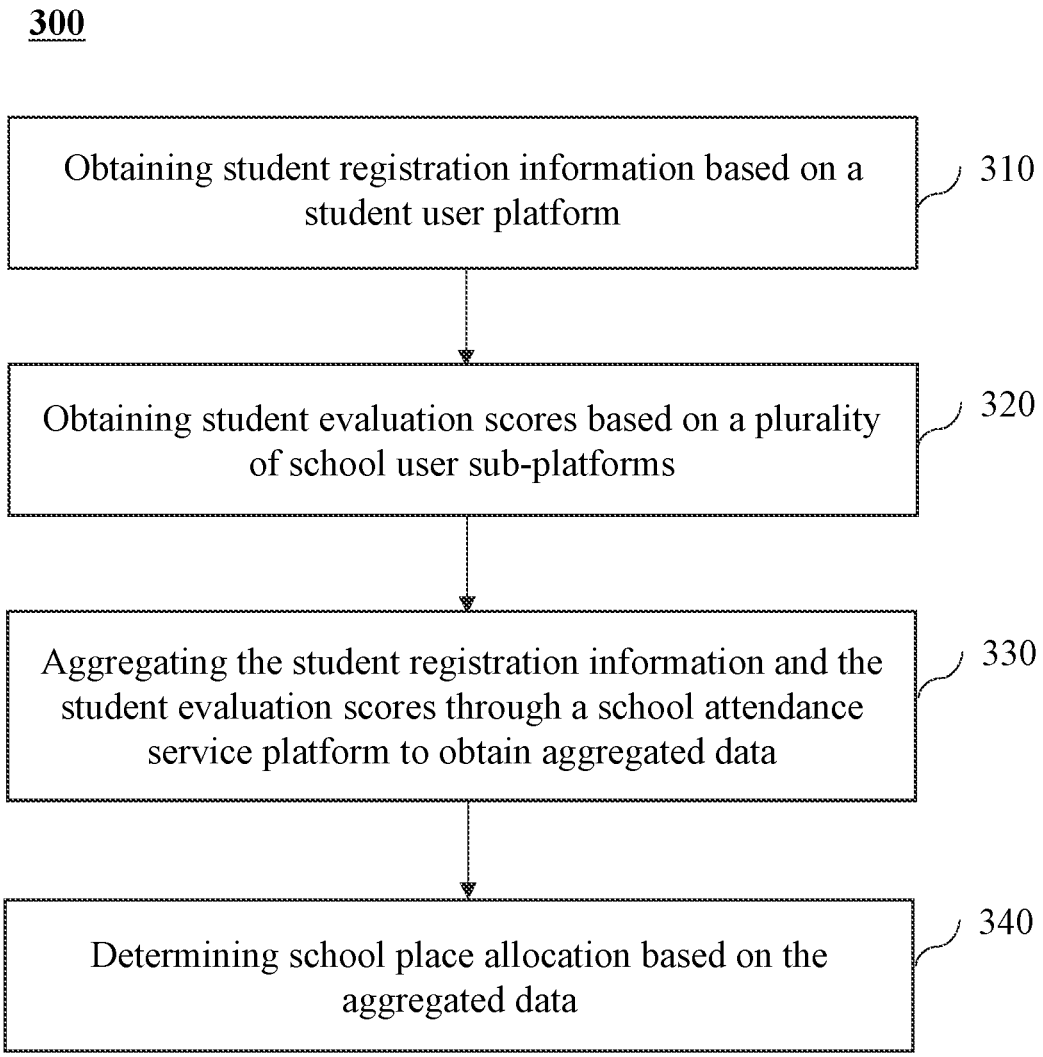
FIG. 3 is an exemplary flowchart illustrating a method for managing school attendance of a smart city based on the Internet of Things according to some embodiments of the present disclosure.

FIG. 3 is an exemplary flowchart illustrating a method for managing school attendance of a smart city based on the Internet of Things according to some embodiments of the present disclosure. As shown in FIG. 3, a process 300 includes the following steps. In some embodiments, the process 300 may be implemented by the school attendance management platform 230.

Step 310, obtaining student registration information based on a student user platform.

Student registration information includes information relevant to determining the school place allocation. In some embodiments, the student registration information may include one or more of the intention of a student for school attendance, a test score of the student, an award certificate of the student, and a comprehensive quality, etc.

The intention of the student for school attendance refers to an interest school that a student wants to attend. The test score of the student refers to the performance obtained by students for the knowledge they have learned. For example, the test score of the student may be a final test score, an athletic test score, and so on. The award certificate of the student is a certificate issued to a student who has been recognized and encouraged for his outstanding performance in a certain area. For example, the award certificate of the student may be a merit student award, an outstanding class cadre award, and so on. The comprehensive quality refers to knowledge level, moral accomplishment, various abilities (e.g., adaptability, survival ability, social ability (including innovation ability, practical ability) and special abilities in sports, literature, art, music, dance, language, etc.) and other comprehensive literacy of the student.

In some embodiments, the school attendance management platform 230 may set a test that may reflect the comprehensive quality, and then judge the comprehensive quality of the student according to a total score obtained by the test of the student. For example, a score larger than or equal to 80 points and less than or equal to 100 points in the test indicates excellent comprehensive quality. The score larger than or equal to 70 points and less than 80 points in the test indicates good comprehensive quality. The score larger than or equal to 60 points and less than 70 points in the test indicates passing comprehensive quality. The score less than 60 points in the test indicates failing comprehensive quality.

In some embodiments, the school attendance management platform 230 may obtain the registration information entered by the students from the student user platform through the network 130.

Step 320, obtaining student evaluation scores based on a plurality of school user sub-platforms.

A student evaluation score refers to a score obtained by an interest school based on the student registration information submitted to the interest school when the student enrolls. The scoring standards and rules may be preset by the schools. For example, when the test score of the student A is excellent, the award certificate of the student A has merit student award, and the comprehensive quality of the student A is excellent, the student evaluation score may be 60 points.

In some embodiments, the school attendance management platform 230 may, base on the intention for school attendance of the student (or the intention of the student for school attendance), send an instruction to the school user sub-platform (e.g., the school user sub-platform 150-1, the school user sub-platform 150-2, the school user sub-platform **150-*n*, etc.) corresponding to the intention for school attendance of the student through the school attendance service platform to obtain the corresponding student evaluation score. Merely by way of example, if the intention for school attendance of the student is school A, the school attendance management platform 230** send an instruction to the school A user sub-platform to obtain the student evaluation score from school A.

In some embodiments, the school attendance management platform may control the school attendance service platform to send the student registration information transmitted by the student user platform to the school user sub-platform corresponding to the intention for school attendance of the student. The school user sub-platform comprehensively scores the student based on the student registration information, and obtains the corresponding student evaluation score. The student evaluation score is then sent to the school attendance management platform through the school attendance service platform.

Step 330, aggregating the student registration information and the student evaluation scores through a school attendance service platform to obtain aggregated data.

In some embodiments, the student registration information is sent from the student user platform to the school attendance service platform through the network. The student evaluation scores may be sent from one or more school user sub-platforms to the school attendance service platform through the network. Based on the school attendance service platform, the student registration information and the student evaluation scores are aggregated, and the aggregated information is sent to the school attendance management platform 230.

Step 340, determining school place allocation based on the aggregated data.

The school place allocation refers to the allocation of the school places of the schools to which the student attends while attending school. The school place allocation may include school place allocation to schools and school place allocation to students, such as determining the student information corresponding to the 300 school places included in school A, or determining the school information of the school that student B may attend to.

In some embodiments, the school attendance management platform 230 may, under the premise of taking into account the intention for school attendance of the student/school selection, nearby enrollment and balance of performance, divide the number of school place allocation for each region based on the number of students in each region corresponding to each school. The more students in a certain area, the more school places will be allocated accordingly. For example, if the total number of school places allocated for school A is x, the number of applicants in region 1 is 30, the number of applicants in region 2 is 60, and the number of applicants in region 3 is 90, then the number of school places allocated for region 1 is 20% x, and the number of school places allocated for region 2 is 30% x, the school places allocated for region 3 is 50% x.

Figure 5:
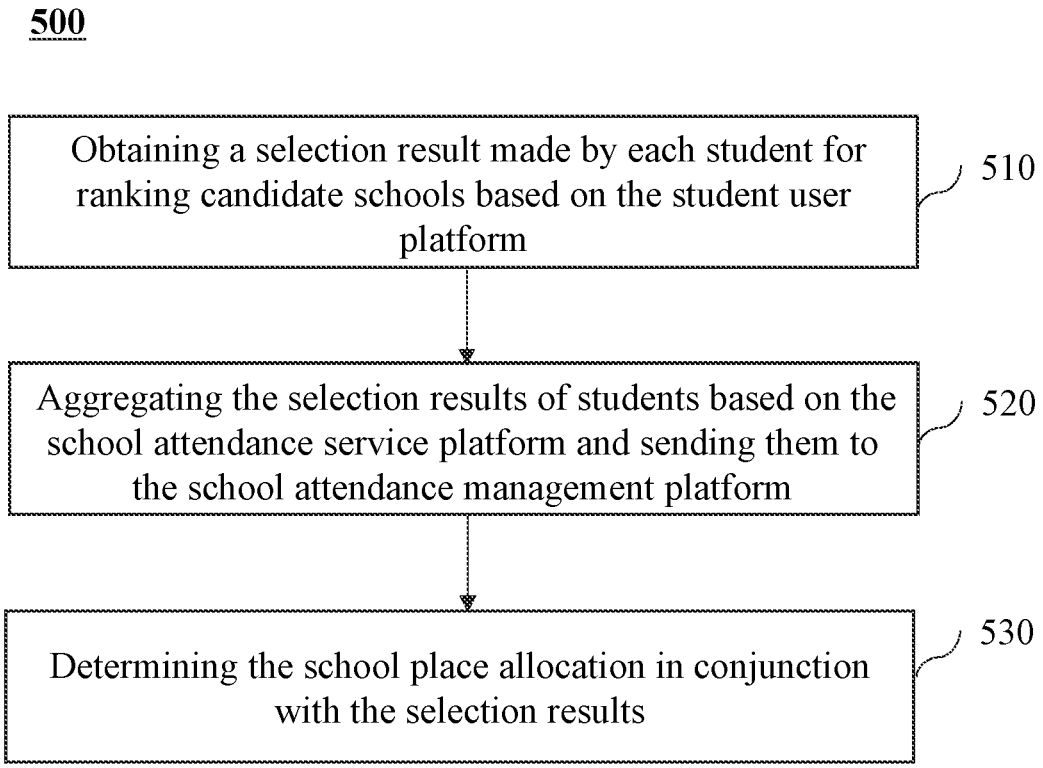
FIG. 5 is an exemplary flowchart illustrating a method for determining a school place allocation according to some embodiments of the present disclosure.

In some embodiments, the attendance management platform 230 may also determine the school place allocation based on the method shown in FIG. 5. For a specific description, refer to the description in FIG. 5 below, which will not be repeated here.

In some embodiments of this specification, the intention for school attendance of the student is obtained by obtaining student registration information. The registration information is sent to the school user sub-platform corresponding to the intention for school attendance of the student, and the student evaluation score in the interest school is obtained. The school place allocation is made based on the student evaluation score and the intention for school attendance of the student. In this way, under the premise of taking into account the intention for school attendance of the student/school selection, nearby enrollment and balance of performance, the school place allocation is automatically realized to ensure the fairness of the school place allocation.

Figure 4:
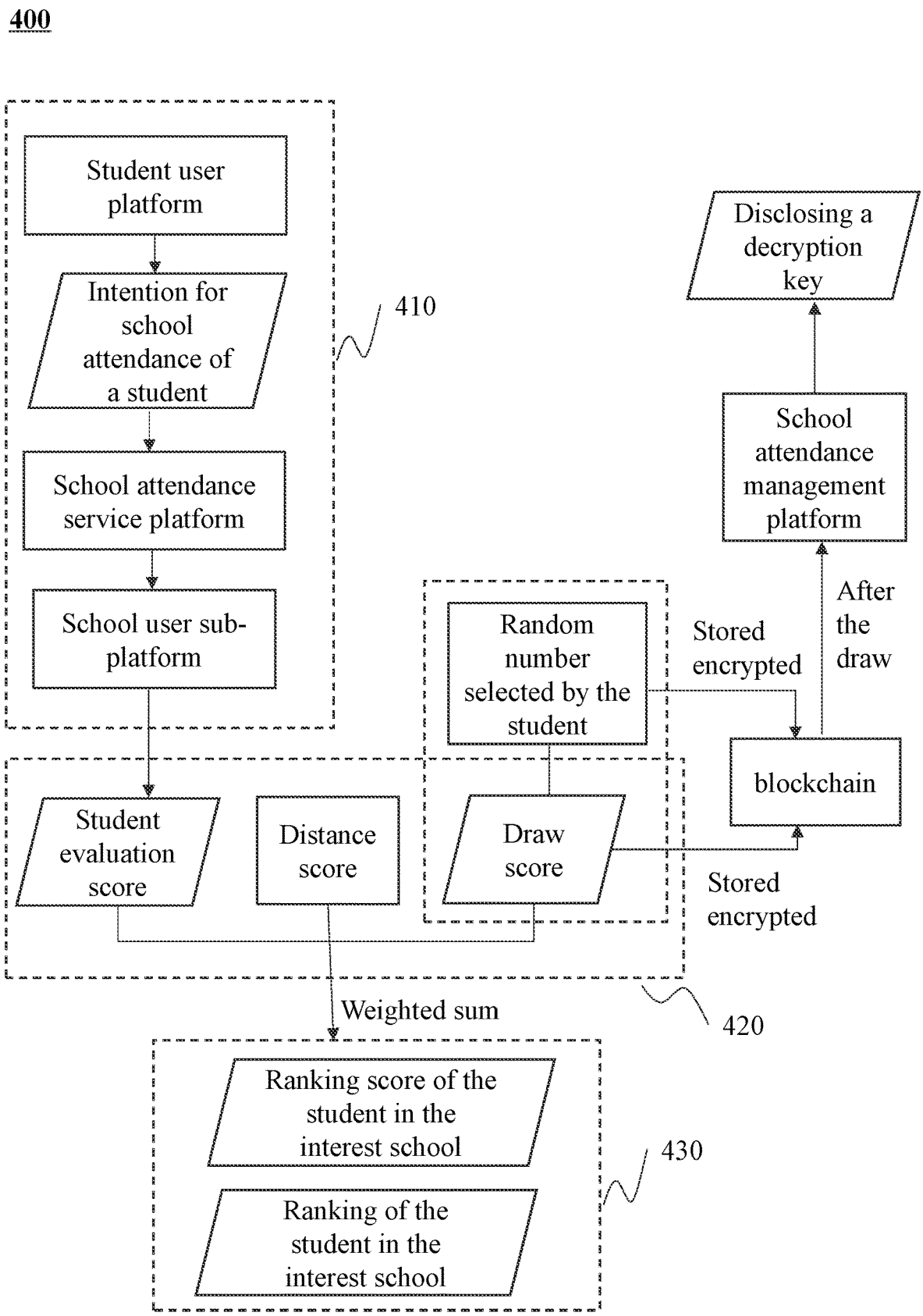
FIG. 4 is an exemplary flowchart illustrating a method for determining a ranking of a student at an interest school according to some embodiments of the present disclosure.

FIG. 4 is an exemplary flowchart illustrating a method for determining a ranking of the student at an interest school according to some embodiments of the present disclosure. In some embodiments, a process 400 may be implemented by the school attendance management platform 230.

Step 410, based on an intention of a student for school attendance, sending an instruction to a school user sub-platform corresponding to the intention for school attendance of the student through the school attendance service platform to obtain a student evaluation score corresponding to the student.

The intention of the student for school attendance refers to the interest school that the student wants to attend. In some embodiments, the intention of the student for school attendance may include one or more interest schools.

In some embodiments, the school attendance management platform 230 may comprehensively score the students and obtain the evaluation scores based on the student registration information submitted to the interest school when the students enroll. For example, the student evaluation score of the student A obtained by the interest school after comprehensively scoring the student A based on the student registration information submitted by the student A to the interest school is 60 points. Please refer to the relevant description of step 320 in FIG. 3 above for a more specific description of how to obtain the student evaluation scores, which will not be repeated here.

Step 420, determining a ranking score of the student at an interest school based on a distance score, the student evaluation score, and a draw score of the student.

The distance score is a score used to reflect the distance between the house of the student and the interest school. The draw score is a score drawn by the student at random. The ranking score is a score that reflect where the student ranks at the interest school.

In some embodiments, the school attendance management platform 230 may obtain the school time and an estimated time of arrival (ETA) between the house of the student and the interest school through the geographic information platform, and determine the distance score of the interest school based on the ETA.

In some embodiments, the longer the ETA, the smaller the distance score. In some embodiments, the school attendance management platform 230 may set the ETA at certain intervals, each interval corresponds to a distance score, and then determine the distance score based on the ETA of the student. For example, the time interval of the ETA may be divided into 0-15 minutes, 15-30 minutes, 30-45 minutes, 45-60 minutes, . . . , and the corresponding distance scores may be 10 points, 8 points, 6 points . . . . If the ETA from the house of the student A to the school is 20 minutes, the corresponding distance score is 8 points.

In some embodiments, the school attendance management platform 230 may determine the draw score of the student based on a variety of methods, for example, allocating each student a random number as a draw score.

In some embodiments, the school attendance management platform 230 may determine the draw score based on the random number selected by the student. In some embodiments, the random number and corresponding draw score are randomly generated and stored in the blockchain.

The random number is a randomly generated number. In some embodiments, the random number and the draw score are in one-to-one correspondence, and the system for managing school attendance 200 randomly generates several pairs of such random numbers and draw scores and stores them in the blockchain. The random number is a public number which is used to draw lots for students. Only after students draw random numbers may they get the corresponding draw scores. For example, if the draw score corresponding to the random number 8 is 20 points, when the random number drawn by student A is 8, the draw score corresponding to student A is 20 points.

In some embodiments, the data in the blockchain (e.g., several pairs of random numbers and draw scores) are encrypted and stored, and the decryption key is also stored in the blockchain for a verification. The decryption key is disclosed by the school management platform after drawing, and the student may know the draw score corresponding to the random number drawn based on the decryption key. At the same time, the decryption key may be checked to see if it is consistent with the one stored in the blockchain to ensure that the decryption key has not been tampered with.

The verification refers to comparing the decryption key of the school attendance management platform with the corresponding decryption key stored in the blockchain, so as to ensure the correctness of the draw scores and avoid tampering with the draw scores.

In some embodiments of the present disclosure, since the decryption key is disclosed by the school attendance management platform after the draw is over, the school attendance management platform may control the timing disclosure of the draw scores, which ensures the reliability of the data. After the decryption key of the school attendance management platform is disclosed, it may be verified whether the decryption key of the school attendance management platform is consistent with the corresponding decryption key stored in the blockchain, ensuring that the decryption key has not been tampered by the school attendance management platform, and further ensuring the reliability of data.

In some embodiments, a ranking score of the student at the interest school may be determined based on a weighted sum of the distance score, the student evaluation score, and the draw score.

In some embodiments, the weighted summation refers to multiplying the distance scores, student evaluation scores, and draw scores by the corresponding weights, and then summing them. In some embodiments, the initial weights corresponding to the distance score, the student evaluation score, and the draw score may be set by the education administration department according to historical school place allocation and experience. In some embodiments, the initial weights may also be adjusted according to the actual situation. For how to adjust the initial weights according to the actual situation, please refer to FIG. 6 and its related description below, which will not be repeated here.

In some embodiments, the ranking score of the student at the interest school may be the score determined based on a weighted sum of the distance score, the student evaluation score, and the draw score. For example, student A has a distance score of 8 points, a student evaluation score of 60 points, a draw score of 20 points, a weight of 1 for the distance score, a weight of 1 for the student evaluation score, and a weight of 0.5 for the draw score, then the ranking score is $8\times1+60\times1+20\times0.5=78$ points.

Step 430, determining a ranking of the student at an interest school based on the ranking score.

The ranking refers to the ranking of the student at an interest school. For example, school A is the interest school of student A, which has a total of 1,000 students enrolled. Based on the ranking score of each student from high to low, the ranking score of student A is 78 points, and then student A is ranked 300th in school A.

In some embodiments, the school attendance management platform 230 may determine the ranking of the student at the interest school based on the ranking score. In some embodiments, the higher the ranking score of the student at the interest school, the higher the ranking of student at the interest school. For example, ranking scores of students A, B, and C at the interest school are 80, 85, and 90, respectively, then the ranking order of students A, B, and C at the interest school is students C, B, and A.

In some embodiments, the ranking score of the student may be the score determined based on the weighted sum of the distance score, the student evaluation score, and the draw score, so under the premise of taking into account the intention of the student for school attendance/school selection, the use of weights ensures nearby enrollment and balance of performance of the student allocated by the school.

FIG. 5 is an exemplary flowchart illustrating a method for determining a school place allocation according to some embodiments of the present disclosure. In some embodiments, a process 500 may be implemented by the school attendance management platform 230.

Step 510, obtaining a selection result made by each student for ranking candidate schools based on the student user platform.

In some embodiments, the ranking candidate schools include at least one school with the highest ranking score corresponding to the student. In some embodiments, the ranking candidate schools are two schools with the highest ranking score corresponding to the student. In some embodiments, if the student chooses one of the two ranking candidate schools, it means that the other school is abandoned by the student, and the students who ranked lower in the other school may make up accordingly. For example, the ranking of student A at the interest school A is 300, and 50 students in front of student A have all abandoned school A, then the ranking of student A at the interest school A becomes 250.

In some embodiments, the student may select the ranking candidate school with the highest ranking. In some embodiments, the student may select the ranking candidate school with a lower ranking but more interested. For example, if the ranking candidate schools of student A include school A and school B, where the ranking of student A at the school A is 300, and the ranking of student A at the school B is 290, student A may select the lower-ranked but more interested school A as the first choice, and the higher-ranked school B as the second choice.

In some embodiments, since the intentions for the two ranking candidate schools are not high, students may choose neither of the two ranking candidate schools, and other students who have selected these two ranking candidate schools may be given priority to obtain a school place. For example, if the ranking candidate schools of student A and student B both include school A and school B, but student A has no high intention for the two ranking candidate school—school A and school B, and student B has high intention for the two ranking candidate school—school A and school B. Therefore, the selection result of student A is that neither school A nor school B is selected, and the selection result of student B is that school A and school B are the first choice and the second choice, then student B may be given priority to school places of these two ranking candidate schools.

In some embodiments, students may not qualify for a school place of the ranking candidate school if they choose the lower-ranked ranking candidate school. If the student does not qualify for a school place of a ranking candidate school, the student may be postponed to the ranking candidate school with the next ranking (provided that the ranking candidate school with the next ranking has remaining places); or wait for the final random allocation to the school with remaining places. For example, if the ranking candidate schools of student A include school A and school B, where student A ranks 300 in school A and 290 in school B. However, the selection result of student A is that the lower-ranked school A is selected as the first choice, and the higher-ranked school B is selected as the second choice. Because the school A has a lower ranking, student A does not have a school place. At this time, if there are still places left in school B, student A may postpone to school B, which is the second choice of student A, to obtain a school place. If school B has no remaining places, student A may wait for the final random allocation to school C with remaining places.

In some embodiments, the selection result of the student may be selected based on the student user platform.

Step 520, aggregating the selection results of the students based on the school attendance service platform and sending them to the school attendance management platform.

In some embodiments, the selection results may be sent to the school attendance service platform for aggregation through the network, and then the school attendance service platform sends the aggregated selection results to the school attendance management platform through the network. For example, if the selection results of students A, B and C are school A, school B, and school C in sequence, the student user platform may send the selection results to the school attendance service platform for aggregation through the network, and then the school attendance service platform may aggregate the selection results and send them to the school attendance management platform through the network.

Step 530, determining the school place allocation in conjunction with the selection results.

In some embodiments, the school attendance management platform 230 may determine the school place allocation based on the selection result of the student. For example, if the selection results of students A, B, and C are school A, school B, and school C in sequence, and students A, B, and C are in the places allocated by the corresponding schools because of the eligible ranking of the students A, B, and C, then the result of the school place allocation of students A, B, and C are school A, school B and school C in sequence.

In some embodiments, the school attendance management platform 230 may also consider the priority of each student's first intention when determining the school place allocation. For example, each school prioritizes students who choose the school as the first choice, and then considers students who choose the school as the second choice when places remain, and so on until the enrollment plan is met. For example, school A has 50 school places, if there are 40 students who enroll school A as their first choice, and 30 students who enroll school A as their second choice, then school A will give priority to admit students whose ranking scores meet the requirements among the 40 students whose first choice is school A, while the remaining school places will be admitted from the 30 students who enroll school A as their second choice. Specifically, the students whose ranking scores meet the requirements are admitted in the order of the ranking scores from high to low.

In some embodiments, the school attendance management platform 230 may predict a student selection probability of each ranking candidate school through a machine learning model, thereby determining and publishing a ranking advance probability.

Student selection probability refers to the probability that a student chooses one of the ranking candidate schools. The ranking advance means that the ranking of students move forward in the interest school. For example, student A is ranked 300th in school A, and 50 students in front of student A have all chosen another school, but not school A, then the ranking of student A in school A may move up 50 places.

The ranking advance probability refers to the probability that a student moves forward in the ranking of the interest school. In some embodiments, the machine learning model may be used to predict the probability that student chooses the ranking candidate school based on the intention for school attendance of the student (e.g., first choice, second choice . . . ), distance score, ranking of the interest school, student evaluation score.

In some embodiments, the machine learning model may be a logistic regression model. In some embodiments, the machine learning model may be obtained by obtaining historical data. The corresponding student selection results (e.g., yes or no) in the historical data may be labelled. The labelled historical data may be input into the initial machine learning model for training to obtain a trained machine learning model. The historical data refers to the historical school place allocation data obtained from one or more of the school user sub-platforms, student user platform, school attendance management platform, and school attendance service platform. For example, the historical school place allocation data may include historical intention for school attendance of the student, historical distance scores, historical ranking of the interest school, historical student evaluation scores, and the like. In some embodiments, the intention for school attendance of the student, distance scores, ranking of the interest school and evaluation scores are used as input data to the trained machine learning model, and the trained machine learning model may output the selection result of the student and the corresponding selection probability.

In some embodiments, the school attendance management platform 230 may separately calculate the selection probability of each higher-ranked student based on the machine learning model, and calculate the probability that the lower-ranked student moves forward. For example, student A is ranked 10th in school A, and based on the machine learning model, the selection probabilities of the front 9 students may be calculated as 0.5, 0.6, 0.7, 0.3, 0.6, 0.6, 0.5, 0.3, and 0.1, respectively, thereby calculating the ranking advance probability P of student A as $1-0.5\times0.6\times0.7\times0.3\times0.6\times0.6\times0.5\times0.3\times0.1=0.9996598$.

According to the calculated the ranking advance probability of student A in school A, it can be known that student A has a higher ranking advance probability in school A. When the ranking of student A moves forward in school A, student A has a higher probability of obtaining a school place from school A. Then student A may choose school A when making the selection result for the ranking candidate schools.

In some embodiments of the present disclosure, by selecting the two ranking candidate schools with the highest ranking scores for students, and then using the machine learning model to predict choices of other people, and then predicting the ranking advance probability of the student in the interest school, which helps students make better choices and avoids unsatisfactory school place allocation due to improper selection.

Figure 6:
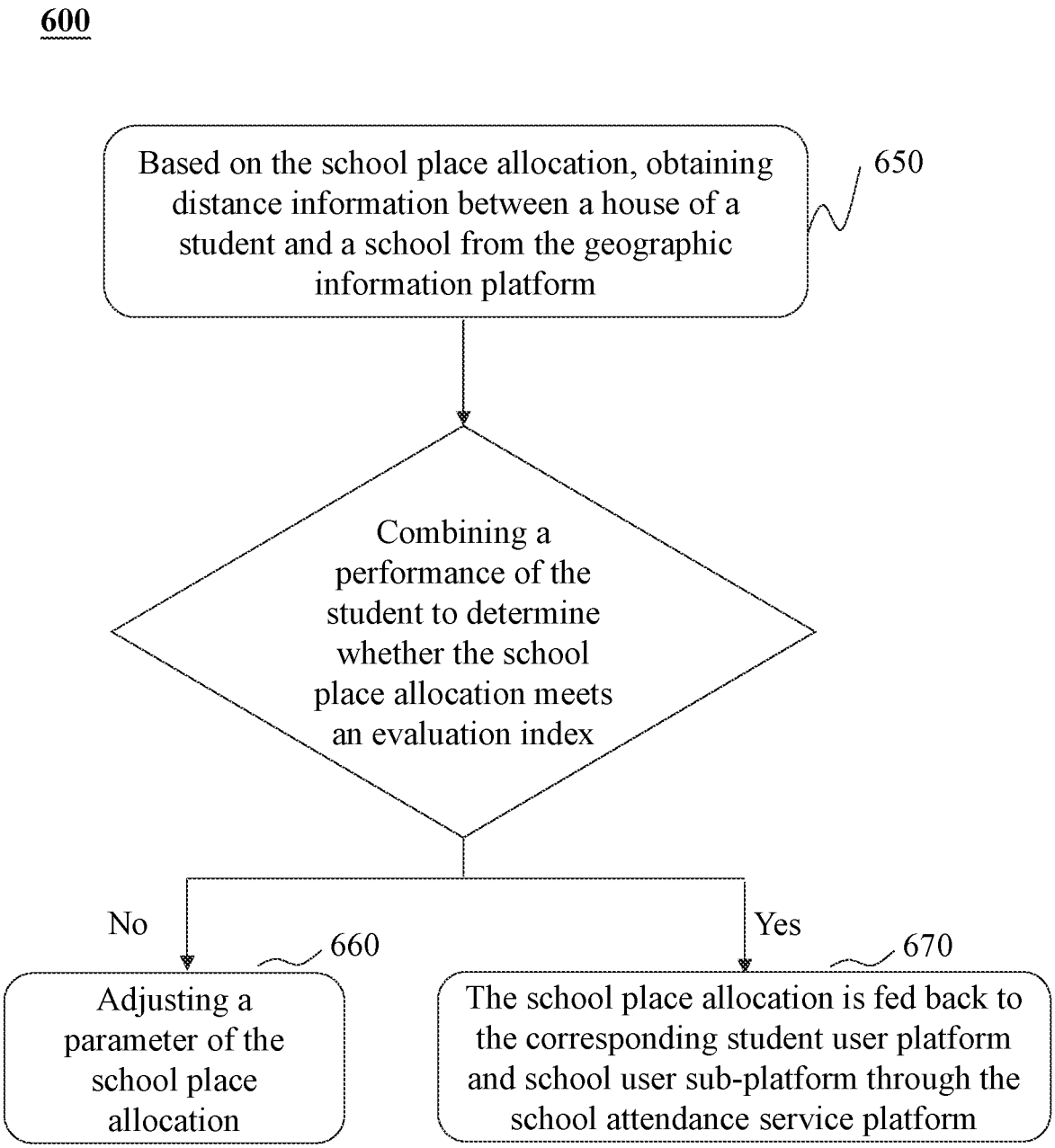
FIG. 6 is an exemplary flowchart illustrating an optimization method for determining a school place allocation according to some embodiments of the present disclosure.

FIG. 6 is an exemplary flowchart illustrating an optimization method for determining a school place allocation according to some embodiments of the present disclosure. In some embodiments, a process 600 may be implemented by the school attendance management platform 230.

Step 650, based on the school place allocation, obtaining distance information between a house of a student and a school from the geographic information platform, and combining a performance of the student to determine whether the school place allocation meets an evaluation index.

For the relevant content of how to obtain the school place allocation, please refer to the above steps 310-340 in FIG. 3 and the related descriptions, which will not be repeated here.

The distance information includes information related to the obtained distance between the house of student and the school. For example, the distance information may be one or more of the location information of the house of the student, the location information of the interest school of student, and the distance between the house of student and the school.

In some embodiments, the school attendance management platform 230 may obtain distance information from a cloud platform outside the IoT through external communication. For example, the school attendance management platform 230 may obtain the distance information between the house of student and the school based on the geographic information platform.

The evaluation index refers to the evaluation criteria used to determine whether the result of the school place allocation satisfies the principle of students going to the nearby school and whether each school meets the principle of balanced student performance through the school place allocation. In some embodiments, the evaluation index may include a range of performance differences among students allocated by various schools based on the school place allocation, and a distribution range of travel time for students to the allocated schools, to determine whether the result of the school place allocation satisfies the principle of students going to the nearby school and whether each school meets the principle of balanced student performance.

In some embodiments, the evaluation index may include an evaluation index of performance allocation and an evaluation index of distance allocation.

The evaluation index of performance allocation refers to the evaluation standard of performance allocation formulated to determine whether the school place allocation result meets the principle of balanced student performance through the school place allocation. For example, the evaluation index of performance allocation may be that the difference in the average scores of students admitted through school place allocation does not exceed a preset score value (e.g., 5 points, 10 points, etc.); and/or, the evaluation index of performance allocation may be that the difference in the proportion of students in each performance level admitted by each school through school place allocation does not exceed a preset percentage (e.g., 5%, 10%, etc.).

The evaluation index of distance allocation refers to the evaluation standard of distance allocation formulated to determine whether the school place allocation result satisfies the principle of students going to the nearby school. For example, the evaluation index of distance allocation may be that the difference between the average commute time for students admitted through school place allocation in each school does not exceed a first preset time value (e.g., 10 minutes, 15 minutes, etc.), and/or, the evaluation index of distance allocation may be that the average commute time for students admitted through school place allocation in each school does not exceed a second preset time value (e.g., 20 minutes, 30 minutes, etc.).

In some embodiments, the preset score and the preset percentage in the set evaluation index of performance allocation may be preset values based on experience. In some embodiments, the school attendance management platform 230 may calculate the differences in the proportion of students enrolled through school place allocation in each performance segment of each school, and compare the maximum difference with the set evaluation index of performance allocation to determine whether the evaluation index of performance allocation is satisfied. In some embodiments, the school attendance management platform 230 may calculate the difference in the average scores of the students admitted through the school place allocation in each school, and compare it with the set evaluation index of performance allocation, to determine whether the evaluation index of performance allocation is satisfied.

In some embodiments, the first preset time value and the second preset time value in the set evaluation index of distance allocation may be preset values based on experience. In some embodiments, the school attendance management platform 230 may calculate the average commute time and the differences of the average commute time of the students enrolled by the school place allocation in each school, and compare the average commute time and the maximum difference with the set evaluation index of distance allocation, to determine whether the evaluation index of distance allocation is satisfied.

In some embodiments, when it is determined that the school place allocation does not meet the evaluation index, the process 600 may further include the following steps.

Step 660, adjusting a parameter of the school place allocation in response to the school place allocation not meeting the evaluation index.

Not meeting the evaluation index means that the school place allocation result does not meet the evaluation index of performance allocation and/or the evaluation index of distance allocation. The parameter are one or more parameters that affect the school place allocation. For example, the parameters may include the number of students enrolled in school A in a certain region, the number of students enrolled by school A in a certain score segment, and the like. Parameter-based adjustments may change the corresponding student evaluation score of a student at school A, such as lowering or raising the evaluation scores of students in a certain region.

In some embodiments, if the school place allocation result does not meet the evaluation index of performance allocation and/or the evaluation index of distance allocation, the school attendance management platform 230 may adjust the admission quota for students in each performance segment of each school and/or the school place allocation quota in each region. For example, if the average commute time of students enrolled in school A through school place allocation exceeds the second preset time value, and school A is the farthest from region 3 and the closest to region 1, then the number of places for school place allocation in region 1 may be increased and the number of places for school place allocation in region 3 may be reduced.

Correspondingly, the student evaluation scores of students in region 1 in school A may be increased. For another example, if the average scores of students enrolled in school A through school place allocation is lower than the set evaluation index of performance allocation, the number of places for school place allocation for students with excellent academic performance in school A may be increased, and the number of places for school place allocation for students with poor academic performance in school A may be reduced. Correspondingly, the student evaluation scores of students with excellent academic performance in school A may be increased.

In some embodiments, when the school attendance management platform 230 adjusts the school place allocation by adjusting the parameters of the school place allocation, it may calculate the weights of the distance score, the student evaluation score and the draw score in the ranking scores of the students in the interest school based on the adjustment. For example, if a student enrolled in school A through the school place allocation has a longer travel time, the weight of the distance score may be increased in calculating the ranking score of the student. For another example, if the performance of students admitted to school B through school place allocation are significantly differentiated, the weight of the draw score may be increased when calculating the ranking score of the student.

In some embodiments of the present disclosure, the school place allocation is adjusted by adjusting the weights of the distance score, the student evaluation score and the draw score, ensuring that the school place allocation satisfies the principles of the nearby enrollment and balance of performance.

Step 670, in response to the school place allocation meeting the evaluation index, the school place allocation is fed back to the corresponding student user platform and school user sub-platforms through the school attendance service platform.

Meeting the evaluation index means that the school place allocation results meet the evaluation index of performance allocation and the evaluation index of distance allocation.

In some embodiments, if the school place allocation results meet the evaluation index of performance allocation and the evaluation index of distance allocation, the school attendance management platform 230 may feed back the school place allocation results to the corresponding student user platform and school user sub-platforms through the school attendance service platform for students and schools to view the status of the school place allocation.

In some embodiments of the present disclosure, a school place allocation result is verified by the evaluation index, and if the evaluation index is not satisfied, the school place allocation parameter is adjusted until the school place allocation result satisfies the evaluation index is obtained. It further ensures that the school place allocation is achieved under the premise of taking into account the intention for school attendance of the student/school selection, nearby enrollment and balance of performance, the school place allocation is automatically realized to ensure the fairness of the school place allocation.

It should be noted that the above description about the process 600 is only for example and illustration, and does not limit the scope of application of the present disclosure. For those skilled in the art, various modifications and changes may be made to the process 600 under the guidance of the present disclosure. However, these modifications and changes are still within the scope of the present disclosure. For example, steps 310-340 may also be included before step 650.

Having thus described the basic concepts, obviously, for those skilled in the art, the above detailed disclosure is merely a way of example, and does not constitute a limitation of the present disclosure. Although not explicitly described herein, various modifications, improvements, and corrections to the present disclosure may occur to those skilled in the art. Such modifications, improvements, and corrections are suggested in the present disclosure, so such modifications, improvements, and corrections still belong to the spirit and scope of the exemplary embodiments of the present disclosure.

Meanwhile, the present disclosure uses specific words to describe the embodiments of the present disclosure. Examples such as "one embodiment," "an embodiment,"

and/or "some embodiments" mean a certain feature, structure, or characteristic associated with at least one embodiment of the present disclosure. Therefore, it should be emphasized and noted that two or more references to "an embodiment" or "one embodiment" or "an alternative embodiment" in various places in the present disclosure are not necessarily referring to the same embodiment. Furthermore, certain features, structures or characteristics of the one or more embodiments of the present disclosure may be combined as appropriate.

Furthermore, unless explicitly stated in the claims, the order of processing elements and sequences, the use of alphanumerics, or the use of other names described in the present disclosure is not intended to limit the order of the processes and methods of the present disclosure. While the above disclosure discusses some presently believed useful embodiments of the present disclosure by way of various examples, but it is to be understood that such details are for purposes of illustration only and that the appended claims are not limited to the disclosed embodiments, but on the contrary, the claims are intended to cover all modifications and equivalent combinations that come within the spirit and scope of the embodiments of the present disclosure, for example, although the implementation of various components described above may be embodied in a hardware device, it may also be implemented as a software only solution, e.g., an installation on an existing server or mobile device.

Similarly, it should be noted that to simplify the expressions disclosed in the present disclosure and thus help the understanding of one or more embodiments of the disclosure, in the foregoing description of the embodiments of the present disclosure, various features may sometimes be combined into one embodiment, drawings or descriptions thereof. However, this method of disclosure does not imply that the subject matter of the description requires more features than that are recited in the claims. Rather, claimed subject matter may lie in less than all features of a single foregoing disclosed embodiment.

Some embodiments use numbers to describe quantities of ingredients and attributes, it should be understood that such numbers used to describe the embodiments, in some examples, use the modifiers "about", "approximately" or "substantially" to retouch. Unless stated otherwise, "about", "approximately" or "substantially" means that a variation of ±20% is allowed for the stated number. Accordingly, in some embodiments, the numerical parameters set forth in the present disclosure and claims are approximations that may vary depending on the desired characteristics of individual embodiments. In some embodiments, numerical parameters should take into account specified significant digits and use a general digit reservation method. Notwithstanding that the numerical fields and parameters used in some embodiments of the present disclosure to confirm the breadth of their ranges are approximations, in specific embodiments, such numerical values are set as precisely as practicable.

For each patent, patent application, patent application publication, and other material, such as article, book, disclosure, publication, document, etc., cited in the present disclosure, the entire contents of which are hereby incorporated into the present disclosure for reference. History application documents that are inconsistent or conflictive with the contents of the present disclosure are excluded, as well as documents (currently or subsequently appended to the present disclosure) limiting the broadest scope of the claims of the present disclosure. It should be noted that, if there is any inconsistency or conflict between the descriptions, definitions, and/or usage of terms in subsidiary information of the present disclosure and the contents of the present disclosure, the descriptions, definitions and/or usage of terms in the present disclosure shall prevail.

Finally, it should be understood that the embodiments described in the present disclosure are only used to illustrate the principles of the embodiments of the present disclosure. Other deformations are also possible within the scope of the present disclosure. Therefore, merely by way of example and not limitation, alternative configurations of the embodiments of the present disclosure may be considered consistent with the teachings of the present disclosure. Accordingly, the embodiments of the present disclosure are not limited to those embodiments expressly introduced and described in the present disclosure.

What is claimed is:

1. A method for managing school attendance of a smart city based on Internet of Things, which is implemented by a processor of a school attendance management platform, the method comprising:

obtaining student registration information based on a student user platform, the student registration information including an intention for school attendance of a student;

obtaining a student evaluation score based on a plurality of school user sub-platforms;

aggregating the student registration information and the student evaluation score through a school attendance service platform;

for each student, determining a ranking score of the student at an interest school based on a weighted sum of a distance score, the student evaluation score, and a draw score of the student, wherein weights of the distance score, the student evaluation score, and the draw score are determined based on an estimated time of arrival (ETA) between a house of the student and the interest school and a performance of the student, the draw score is determined based on a random number selected by the student, the random number and the corresponding draw score are randomly generated and stored in a blockchain, the blockchain stores a decryption key; when the random number is selected by the student, sending the decryption key to the student user platform, such that based on the decryption key of the school attendance management platform, the student obtains the draw score corresponding to the random number by the student user platform, and determines, by the student user platform, whether the decryption key of the school attendance management platform is tempered by comparing the decryption key obtained from the school attendance management platform with the decryption key obtained from the blockchain to verify the reliability of the draw score;

determining a ranking of the student at the interest school based on the ranking score, including:

determining, separately, a student selection probability of each higher-ranked student based on a machine learning model, and obtaining a probability that a lower-ranked student moves forward, wherein the machine learning model is a logistic regression model; and the machine learning model is obtained through a training process by the processor of the school attendance management platform, the training process comprising:

receiving a historical data from a storage device, wherein the historical data is a historical school place allocation data obtained from one or more of the school user sub-platforms, the student user platform, the school attendance management platform, and the school attendance service platform, and the historical school place allocation data includes historical intention for school attendance of the student, historical distance scores, historical ranking of the interest school, historical student evaluation scores;

generating a labeled historical data by labeling a corresponding student selection result (yes or no) in the historical data;

inputting the labeled historical data into an initial machine learning model for training to obtain a trained machine learning model;

predicting the student selection probability by processing the intention for school attendance of the student, the distance score, the ranking of the student at the interest school, and the student evaluation score using the trained machine learning model, determining a ranking advance probability based on the student selection probability, and publishing the ranking advance probability to the student;

obtaining a selection result made by the student for ranking candidate schools based on the student user platform and the ranking advance probability; wherein the ranking candidate schools include at least one school with the highest ranking score corresponding to the student; and the selection result includes at most selecting one of the ranking candidate schools;

aggregating selection results of students based on the school attendance service platform and sending the selection results to the school attendance management platform;

determining school place allocation in conjunction with the selection results;

based on the school place allocation, obtaining distance information between houses of the students and schools from a geographic information platform, and determining whether the school place allocation meets an evaluation index in combination with the performance of the students; and adjusting a parameter of the school place allocation in response to the school place allocation not meeting the evaluation index.

2. The method of claim 1, wherein the obtaining a student evaluation score based on a plurality of school user sub-platforms includes:

for each student, based on the intention for school attendance of the student, sending an instruction to a school user sub-platform corresponding to the intention for school attendance of the student through the school attendance service platform to obtain the student evaluation score corresponding to the student.

3. A non-transitory computer-readable storage medium storing computer instructions, wherein when reading the computer instructions in the storage medium, a computer implements the method for managing school attendance of the smart city based on the Internet of Things of claim 1.

4. A system for managing school attendance of a smart city based on the Internet of Things, comprising: a school attendance management platform, a school attendance service platform, and a user platform, wherein the user platform includes a student user platform and a school platform; and the school platform includes a plurality of school user sub-platforms; wherein a processor of the school attendance management platform is configured to:

obtain student registration information based on a student user platform, the student registration information including an intention for school attendance of a student;

obtain a student evaluation score based on a plurality of school user sub-platforms;

aggregate the student registration information and the student evaluation score through a school attendance service platform;

for each student, determine a ranking score of the student at an interest school based on a weighted sum of a distance score, the student evaluation score, and a draw score of the student, wherein weights of the distance score, the student evaluation score, and the draw score are determined based on an estimated time of arrival (ETA) between a house of the student and the interest school and a performance of the student, the draw score is determined based on a random number selected by the student, the random number and the corresponding draw score are randomly generated and stored in a blockchain, the blockchain stores a decryption key; when the random number is selected by the student, send the decryption key to the student user platform, such that based on the decryption key of the school attendance management platform, the student obtains the draw score corresponding to the random number by the student user platform, and determines, by the student user platform, whether the decryption key of the school attendance management platform is tempered by comparing the decryption key obtained from the school attendance management platform with the decryption key obtained from the blockchain to verify the reliability of the draw score;

determine a ranking of the student at the interest school based on the ranking score, including:

determine, separately, a student selection probability of each higher-ranked student based on a machine learning model, and obtaining a probability that a lower-ranked student moves forward, wherein the machine learning model is a logistic regression model; and the machine learning model is obtained through a training process by the processor of the school attendance management platform, the training process comprising:

receiving a historical data from a storage device, wherein the historical data is a historical school place allocation data obtained from one or more of the school user sub-platforms, the student user platform, the school attendance management platform, and the school attendance service platform, and the historical school place allocation data includes historical intention for school attendance of the student, historical distance scores, historical ranking of the interest school, historical student evaluation scores;

generating a labeled historical data by labeling a corresponding student selection result (yes or no) in the historical data;

inputting the labeled historical data into an initial machine learning model for training to obtain a trained machine learning model;

predict the student selection probability by processing the intention for school attendance of the student, the distance score, the ranking of the student at the interest school, and the student evaluation score using the trained machine learning model, determine a ranking advance probability based on the student selection probability, and publish the ranking advance probability to the student;

obtain a selection result made by the student for ranking candidate schools based on the student user platform and the ranking advance probability; wherein the ranking candidate schools include at least one school with the highest ranking score corresponding to the student; and the selection result includes at most selecting one of the ranking candidate schools;

aggregate selection results of students based on the school attendance service platform and send the selection results to the school attendance management platform;

determine school place allocation in conjunction with the selection results;

based on the school place allocation, obtain distance information between houses of the students and schools from a geographic information platform, and determine whether the school place allocation meets an evaluation index in combination with the performance of the students; and adjust a parameter of the school place allocation in response to the school place allocation not meeting the evaluation index.

5. The system of claim 4, wherein to obtain a student evaluation score based on a plurality of school user sub-platforms, the school attendance management platform is configured to:

for each student, based on the intention for school attendance of the student, send an instruction to a school user sub-platform corresponding to the intention for school attendance of the student through the school attendance service platform to obtain the student evaluation score corresponding to the student.

* * * * *